United States Patent [19]

Flight

[11] Patent Number: 4,654,928

[45] Date of Patent: Apr. 7, 1987

[54] ADJUSTABLE FRICTION BLOCK AND TACKLE WINDOW BALANCE SYSTEM

[75] Inventor: Robert S. Flight, Rochester, N.Y.

[73] Assignee: Caldwell Manufacturing Company, Rochester, N.Y.

[21] Appl. No.: 850,719

[22] Filed: Apr. 11, 1986

[51] Int. Cl.[4] ..... E05F 1/00

[52] U.S. Cl. ..... 16/199; 254/391; 16/DIG. 16

[58] Field of Search ..... 16/199, 196, 198, 197, 16/DIG. 16, DIG. 20; 49/445; 74/567, 568, 568 FS; 254/378, 391

[56] References Cited

U.S. PATENT DOCUMENTS

| | | | |
|---|---|---|---|
| 432,137 | 7/1890 | Jenkins | 16/198 |
| 514,005 | 2/1894 | Howard | 16/198 |
| 1,642,162 | 9/1927 | Londick | 16/198 |
| 1,654,682 | 1/1928 | Dulczewski | 254/391 |
| 1,699,267 | 1/1929 | Appleby | 16/198 |
| 1,762,821 | 6/1930 | Kersting | 16/198 |
| 3,358,404 | 12/1967 | Dinsmore | 49/446 |
| 4,517,766 | 5/1985 | Haltof | 49/417 |

FOREIGN PATENT DOCUMENTS

| | | | |
|---|---|---|---|
| 249227 | 3/1926 | United Kingdom | 16/198 |

*Primary Examiner*—Kuang Y. Lin
*Assistant Examiner*—Karen Skillman
*Attorney, Agent, or Firm*—Stonebraker, Shepard & Stephens

[57] ABSTRACT

A block and tackle window sash balance system 10 has its friction made adjustable by a friction spring 20 and a cam 30 arranged for pressing spring 20 against a radial face of a pulley 15 in a high friction position and moving the spring clear of the pulley in a low friction position. Cam 30 is preferably accessible with a screwdriver for adjusting friction after the balance is installed in a window.

32 Claims, 4 Drawing Figures

ADJUSTABLE FRICTION BLOCK AND TACKLE WINDOW BALANCE SYSTEM

BACKGROUND

An improperly balanced window sash will not stay wherever it is set it will "hop" if overbalanced and "drop" if underbalanced. The remedy is to use a different balance system that more accurately matches the sash weight. A difficulty with this is that a large inventory of balance systems with slightly different balance forces must be available to match the correspondingly large variety of sash sizes and weights, and this adds to the expense of balancing sashes.

Although relief for this problem has been devised for some types of window balance systems (see for example U.S. Pat. No. 4,517,766), no relief has been proposed for balance systems of the block and tackle type. These involve a strong spring with a large spring force and a block and tackle system using pulleys and a cord to reduce and spread the spring force over the distance traveled by the sash (see for example U.S. Pat. No. 3,358,404). To help reduce the size inventory necessary for block and tackle type window balance systems, I have devised a variable friction device that can change the friction of a single block and tackle window balance system so that it accommodates a wider range of sash weights. My variable friction device is also made simple, effective, adjustable after installation with a sash, and inexpensive enough to scarcely increase the cost of a block and tackle window balance system.

SUMMARY OF THE INVENTION

My adjustable friction device for a block and tackle window balance system uses a spring adjacent a radial face of a pulley that rotates adjacent a fixed support so that the spring can frictionally engage the pulley face and press the pulley against the fixed support to increase its rotational friction. A two-position cam, movable between high and low friction positions, moves the spring between corresponding high and low friction positions. The spring preferably clears the pulley face in the low friction position in which the pulley turns freely. The cam is preferably screwdriver adjustable after installation with a sash so that the friction of the balance system can be readily adjusted to match the needs of the sash it counterbalances.

DRAWINGS

FIG. 1 is a fragmentary front elevational view of a block and tackle window balance system having my adjustable friction device;

FIG. 2 is a fragmentary and partially cutaway side elevational view of the balance system of FIG. 1 with the adjusting cam rotated 180°; and FIGS. 3 and 4 are enlarged and fragmentary views of the friction device of FIG. 2, taken along the line 3—3 thereof, and showing a high friction position in FIG. 3 and a low friction position in FIG. 4.

DETAILED DESCRIPTION

My way of adjusting the friction of a block and tackle window balance system can apply to several forms of these systems, including balances fixed in window frames and balances movable with sashes. U.S. Pat. No. 3,358,404 is an example of the latter, and the drawings illustrate application of my friction device to such a block and tackle balance system.

Figure 1:
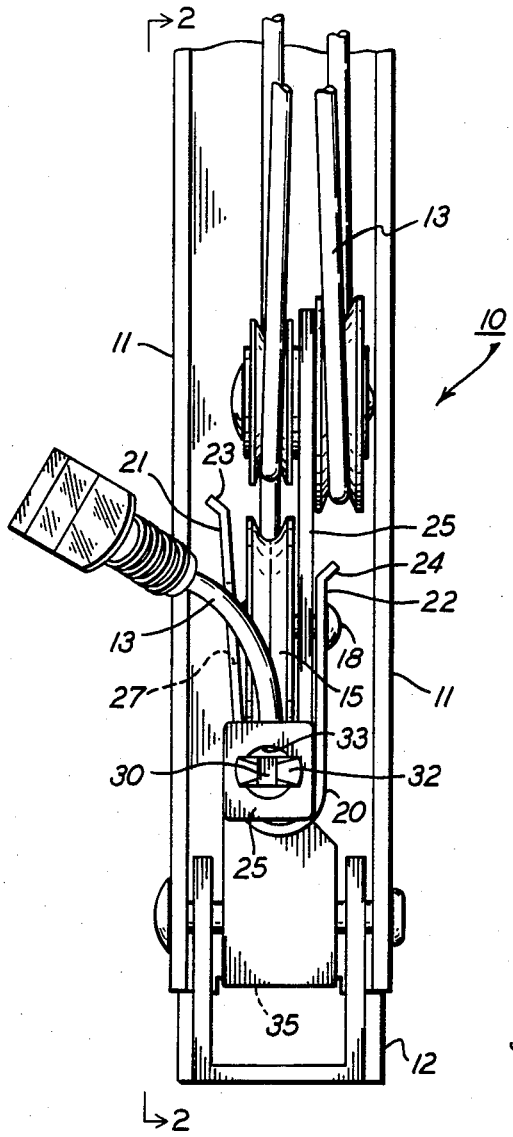
Figure 2:
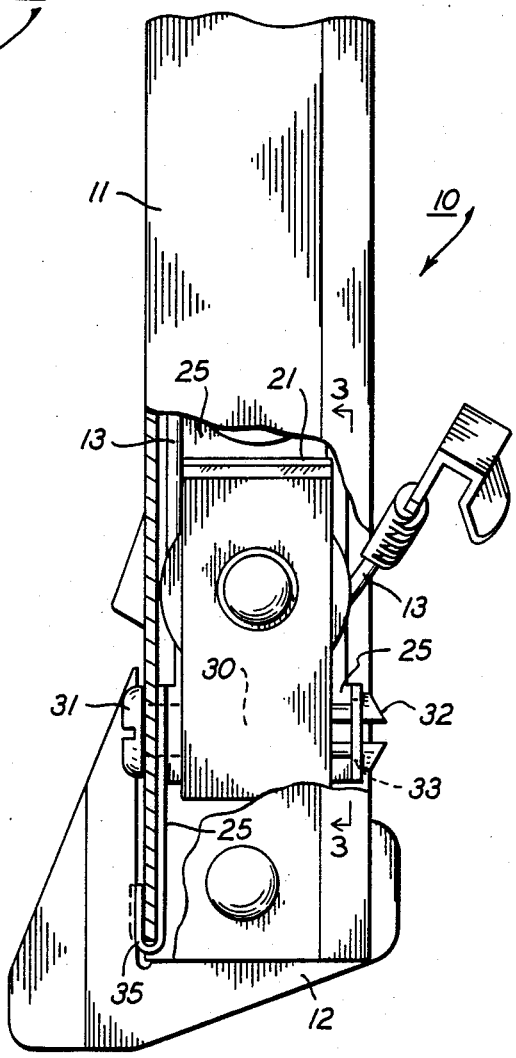

Block and tackle window balance system 10, the lower end of which is shown in FIGS. 1 and 2, is contained within a channel 11 that fits into a plow region of a sash. The unshown upper end of channel 11 contains a tension spring, the remaining pulleys, and the rest of cord 13 arranged for counterbalancing the sash. The weight of the sash rests on a bottom guide 12, and balance system 10 can be blocked against upward movement so that the sash can be lifted above bottom guide 12 for adjusting my friction device. One or two balance systems 10 support each side of a sash with their combined force. The constant friction provided by the pulleys and cord is made adjustable by my invention.

I apply an adjustable friction device to one of the pulleys of a block and tackle window balance system, and I prefer that the pulley subject to adjustable friction be the output pulley, although other pulleys can also serve for varying the system friction. As applied to pulley 15 as shown in the drawings, I prefer a generally U-shaped friction spring 20 straddling pulley 15 and its fixed support bracket 25 so that one spring leg 21 engages an exposed radial face of pulley 15 and another spring leg 22 engages a side of support bracket 25 opposite pulley 15. The space between spring legs 21 and 22, when spring 20 is relaxed, is less than the total width of pulley 15 and its support bracket 25 so that pulley 15 and its support bracket 25 are squeezed between spring legs 21 and 22. This presses spring leg 21 frictionally against radial face 16 of pulley 15, and it also presses opposite radial face 17 of pulley 15 frictionally against support bracket 25.

Figure 3:
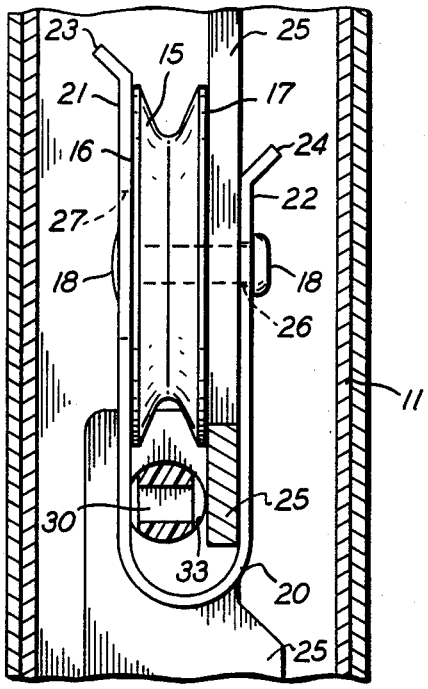
Figure 4:
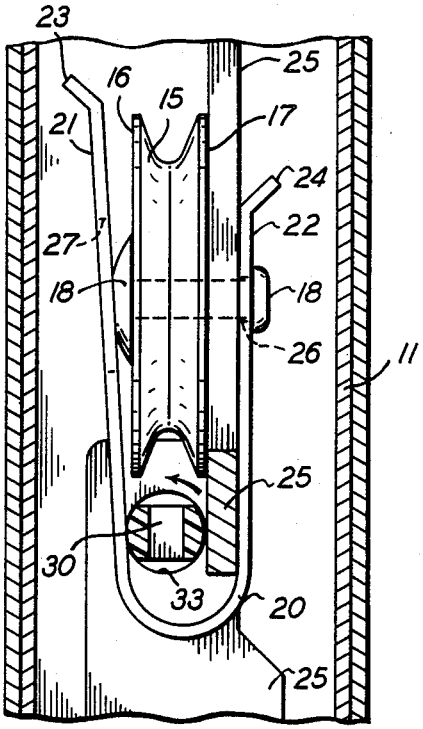

A cam 30, having a screw head 31 and a split end 32 shaped for a snap fit connection into hole 33 in bracket 25, is disposed between spring legs 21 and 22 where it is disengaged from spring 20 in the high friction position shown in FIG. 3. By turning screw head 31 and cam 30 a quarter turn to the position shown in FIG. 4, spring legs 21 and 22 are spread apart and disengage from pulley 15, which then turns freely in a low friction position.

Bracket 25, besides supporting pulley 15, spring 20, and cam 30, also supports other pulleys at the lower end of balance system 10. Once these components are assembled on bracket 25, it is simply attached to the lower end of channel 11 by hook 35.

The ends 23 and 24 of spring legs 21 and 22 are flared slightly outward as illustrated, and spring legs 21 and 22 each have holes 26 and 27 that encircle the ends of a rivet 18 so that spring 20 can be slid on to and snap over rivet 18. This allows friction spring 20 to be a simple clip-on that is installed as balance 10 is assembled, and the encirclement of holes 26 and 27 around the ends of rivet 18 holds spring 20 in place.

Since at least one balance 10 is used at each side of a sash, my friction devices allow a minimum of three friction adjustments for each sash. Two of these result from setting both balances either high or low, and the third results from setting one balance high and the other low. Two balances on each side of a sash allows five different friction settings.

All that is necessary to change the friction adjustment of springs 20 is to lock the balances 10 against upward movement, lift the sash above bottom guides 12, and turn screw heads 31 with a screwdriver. This allows on-site adjustment of the friction of a balance system to accommodate a particular sash.

It is also possible according to my invention to use a straight spring, rather than a U-shaped one, engaging a radial face of a pulley. Then whatever the shape of the friction spring, a two-position cam can be arranged to press it against a pulley face in a high friction position and disengage it from the spring in a low friction position, instead of doing the opposite as shown in the drawings. A U-shaped spring can also be arranged to straddle only a pulley, and not the pulley support, so that opposite legs of the spring engage or disengage from opposite faces of a pulley.

I claim:

1. In a block and tackle window balance system having a pulley with a radial face disposed adjacent a fixed support and a spring arranged adjacent a radial face of said pulley opposite said support, the improvement comprising:

a. a cam movable between high and low friction positions;

b. said cam being accessible when said block and tackle window balance system is mounted in a window so that said cam can be moved between said positions;

c. said cam being disposed to engage said spring in at least one of said positions; and d. said spring being in frictional engagement with said pulley when said cam is in said high friction position, and said spring being out of engagement with said pulley when said cam is in said low friction position.

2. The improvement of claim 1 wherein said cam engages said spring in said low friction position.

3. The improvement of claim 1 wherein said cam has a head disposed to be rotatable by a screwdriver.

4. The improvement of claim 1 wherein said spring is U-shaped and straddles said pulley and said support.

5. The improvement of claim 4 wherein said pulley is mounted on said support by a rivet, and legs of said U-shaped spring have holes located for surrounding ends of said rivet.

6. The improvement of claim 5 wherein said cam engages said spring in said low friction position.

7. The improvement of claim 6 wherein said cam has a head disposed to be rotatable by a screwdriver.

8. The improvement of claim 1 wherein said pulley is an output pulley for said balance system.

9. The improvement of claim 8 wherein said spring is U-shaped and straddles said pulley and said support.

10. An adjustable friction device for a rotatable pulley of a block and tackle window balance system, said adjustable friction device comprising:

a. a U-shaped spring straddling said pulley; and b. a cam arranged for moving said spring between a low friction position clear of said pulley and a high friction position in which a leg of said spring frictionally presses against a radial face of said pulley.

11. The device of claim 10 wherein said pulley is an output pulley for said balance system.

12. The device of claim 10 wherein said pulley is rotatably mounted on a fixed support, and legs of said U-shaped spring straddle said pulley and said support.

13. The device of claim 12 including a rivet mounting said pulley on said support, and wherein said legs of said spring have holes located for surrounding ends of said rivet.

14. The device of claim 13 wherein said pulley is an output pulley for said balance system.

15. The device of claim 10 wherein said cam is accessible when said block and tackle window balance system is mounted in a window so that said cam can be moved to cause movement of said spring between said high and low friction positions.

16. The device of claim 10 wherein said cam engages a leg of said spring when said spring is in said low friction position.

17. The device of claim 10 wherein said pulley is rotatably mounted on a fixed support, legs of said U-shaped spring straddle said pulley and said support, and said cam is accessible when said block and tackle window balance system is mounted in a window so that said cam can be moved to cause movement of said spring between said high and low friction positions.

18. The device of claim 17 including a rivet mounting said pulley on said support, said legs of said spring have holes located for surrounding ends of said rivet, and said cam engages a leg of said spring when said spring is in said low friction position.

19. A method of adjusting the rotational friction of a pulley in a block and tackle window balance system, said method comprising:

a. straddling said pulley with legs of a U-shaped spring biased for resiliently engaging a radial face of said pulley to increase the friction of rotation of said pulley; and b. moving a cam to spread said spring legs apart to disengage said spring from said pulley for allowing said pulley to rotate frictionally free of said spring.

20. The method of claim 19 including disposing a head of said cam to be accessible by a screwdriver for moving said cam when said window balance system is installed in a window.

21. The method of claim 19 including arranging said cam to move clear of said spring when said spring resiliently engages a radial face of said pulley and to engage a leg of said spring for disengaging said spring from said pulley.

22. The method of claim 19 wherein said pulley is an output pulley for said balance system.

23. The method of claim 19 including mounting said pulley on a fixed support and straddling said support and said pulley with said U-shaped spring.

24. The method of claim 23 including riveting said pulley to said support and forming holes in said legs of said spring to encircle ends of said rivet.

25. The method of claim 23 including using pressure of said spring against said radial face of said pulley to press an opposite radial face of said pulley frictionally against said support.

26. The method of claim 25 including disposing the head of said cam to be accessible by a screwdriver for moving said cam when said window balance system is installed in a window.

27. The method of claim 26 including riveting said pulley to said support and forming holes in said legs of said spring to encircle ends of said rivet.

28. A cam-operated friction spring for use in varying the rotational friction of a pulley of a block and tackle window balance system, said friction spring comprising:

a. said spring being biased to press against a radial face of said pulley;

b. said cam operating said spring being disposed for engaging said spring in a low friction position to move said spring clear of said radial face of said pulley and for disengaging from said spring in a high friction position allowing said spring to press against said radial face of said pulley; and c. said cam being accessible for movement when said window balance system is installed in a window.

29. The spring of claim 28 wherein said spring is U-shaped and has legs that straddle said pulley.

30. The spring of claim 29 wherein said legs of said spring are shaped for straddling said pulley and a fixed support mounting said pulley.

31. The spring of claim 30 wherein said legs of said U-shaped spring have holes positioned to surround the ends of a rivet mounting said pulley on said support.

32. The spring of claim 31 wherein distal ends of said spring legs are flared outward to facilitate sliding said spring legs over said rivet ends.

* * * * *